United States Patent [19]

Gartner

[11] Patent Number: 4,525,963

[45] Date of Patent: Jul. 2, 1985

[54] SECTION FOR MOUNTING A CURTAIN WALL

[75] Inventor: Karl Gartner, Gundelfingen, Fed. Rep. of Germany

[73] Assignee: Yoshida Kogyo K. K., Tokyo, Japan

[21] Appl. No.: 519,189

[22] Filed: Aug. 1, 1983

[30] Foreign Application Priority Data

Aug. 2, 1982 [JP] Japan ..... 57-116166[U]

[51] Int. Cl.[3] ..... E04H 1/00

[52] U.S. Cl. ..... 52/235; 52/731; 52/403

[58] Field of Search ..... 52/731, 235, 730, 403

[56] References Cited

U.S. PATENT DOCUMENTS 4,144,690 3/1979 Avery ..... 52/731

4,395,862 8/1983 Jäger et al. ..... 52/403 X

*Primary Examiner*—Carl D. Friedman

*Attorney, Agent, or Firm*—Hill, Van Santen, Steadman & Simpson

[57] ABSTRACT

A section for building in which a section body is formed with a plurality of differently directed mounting recesses for connecting other members so as to also serve as, for example, a vertical frame member and a horizontal frame member for a curtain wall. The section for building has a hollow lengthy section body, a mounting piece projected from one shorter side wall of the section body, and a plurality of differently directed mounting recess for mounting other members, at least one of which being first mounting recess formed perpendicularly to a plane including the mounting piece and extending in the longitudinal direction of the section body and others of which being second and third mounting recesses formed in parallel with the plane.

4 Claims, 8 Drawing Figures

SECTION FOR MOUNTING A CURTAIN WALL

BACKGROUND OF THE INVENTION

1. Field of the Invention

This invention relates to sections for building, and more particularly to a section for building which is used, for example, as a vertical frame member and a horizontal frame member for a curtain wall.

2. Description of the Prior Art

A seal member such as a packing band is mounted between the vertical frame members, a connecting member mounted between the horizontal frame members, and a flashing plate mounted on the lower end of the horizontal frame member.

Therefore, the vertical frame members and horizontal frame members for the curtain wall must have different shapes, and if the number of sections or the number of parts increases, an inconvenience results.

SUMMARY OF THE INVENTION

The present invention has been achieved in view of the above-described circumstances. It is an aspect of the present invention to provide a section for building in which a section body is formed with a plurality of differently directed mounting recesses for connecting other members so as to also serve as, for example, a vertical frame member and a horizontal frame member for a curtain wall.

To achieve the foregoing aspect, in accordance with the present invention, there is provided with a section for building comprising a substantially rectangular hollow lengthy section body, a mounting piece projected from a relatively shorter side wall of the section body facng the outside of the building, and a plurality of differently directed mounting recess for mounting other members, at least one of which being first mounting recess formed perpendicularly to a plane including the mounting piece and extending in the longitudinal direction of the section body and others of which being second and third mounting recesses formed in parallel with the plane.

Further, in accordance with the present invention, there is provided with a section for building characterized in that said mounting piece is integrally formed on a relatively shorter side wall of the section body facing the outside of the building.

Further, in accordance with the present invention, there is provided with a section for building characterized in that said first mounting recess is relatively wide and deep, while said second and said third recesses are relatively narrow and shallow.

Still further, in accordance with the present invention, there is provided with a section for building characterized in that said second and third recesses are adjacent to each other.

BRIEF DESCRIPTION OF THE DRAWINGS

The above and many other advantages, features and additional objects of the present invention will become manifest to those versed in the art upon making reference to the following detailed description and accompanying drawings in which preferred structural embodiments incorporating the principles of the present invention are shown by way of illustrative example.

and FIG. 8 is a sectional view taken on line VIII—VIII of FIG. 7.

DETAILED DESCRIPTION OF THE INVENTION

An embodiment of the present invention will now be described with reference to the drawings.

Figure 1:
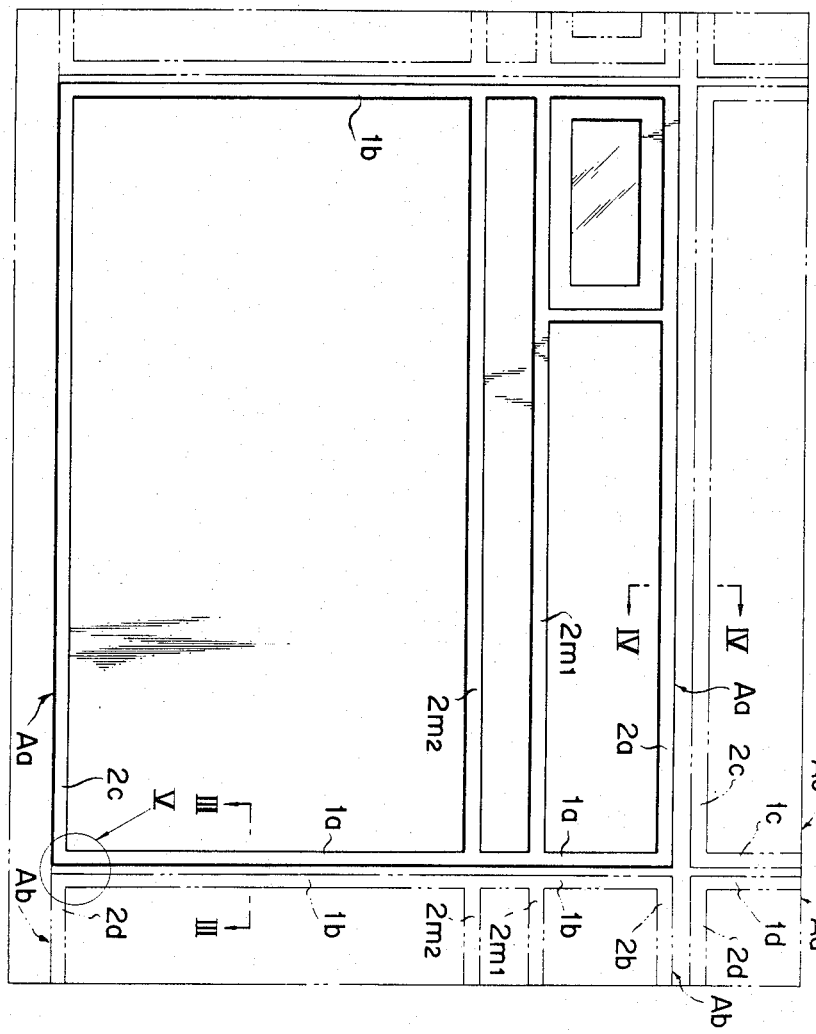
FIG. 1 is a front view showing a curtain wall.

FIG. 1 is a front view showing a curtain wall, which has a construction wherein unit curtain wall units Aa, Ab, Ac, Ad are mounted in plural number at top and bottom and left and right.

Each of the unit curtain wall units has a shape in which a pair of vertical frame members 1*a*, 1*b*, an upper horizontal member 2*a*, a pair of intermediate horizontal members $2m_1$, $2m_2$ and and a lower horizontal member 2*c* are connected in the form of a substantially square frame.

Figure 2:
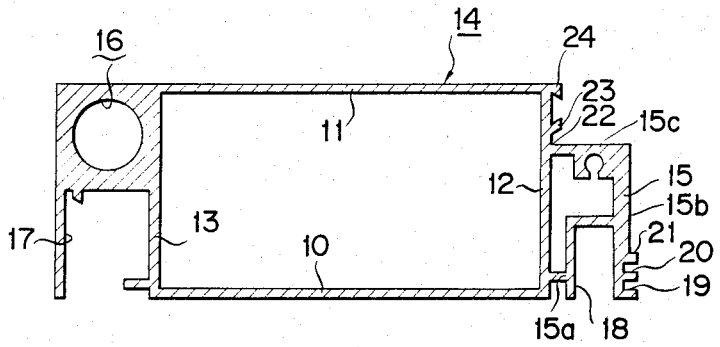
FIG. 2 is a sectional view of a section.

A section for constituting the vertical frame members 1*a*, 1*b* and the horizontal members 2*a*, $2m_1$, $2m_2$, 2*c* has a shape as shown in FIG. 2.

That is, a section body 14 in the form of a hollow lengthy member is composed of both longer side walls 10, 11 and both shorter side walls 12, 13. One of the shorter side wall 12 is formed with a mounting piece 15, while the other shorter side 13 is formed with a longitudinally continuous hollow portion 16 and a recess 17 open towards the side wall 10, the mounting piece 15 having a Z-shaped side wall 15*a* formed with a first large mounting recess 18 and an end wall 15*b* perpendicular to the Z-shaped side wall 15*a* being formed with second and third small mounting recesses 19, 20, the end wall 15*b* being formed with a shoulder 21, another side wall 15*c* and the shorter side wall 12 of the section body 14 constituting a shoulder 22, said shorter side wall 12 being integrally formed with a pair of locking projections 23 and 24.

Figure 3:
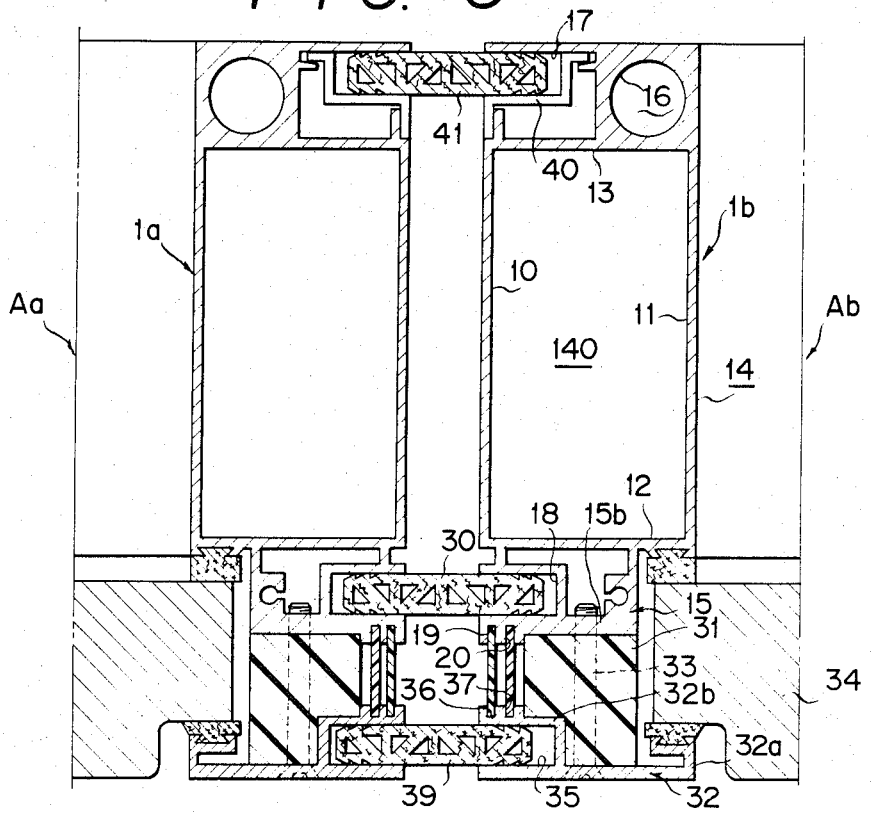
FIGS. 3 and 4 are sectional views taken along line III—III and line IV—IV, respectively, of FIG. 1.

In case of using as the vertical frame member, the section is mounted so that one side wall 10 is directed outwardly as shown in FIG. 3 which shows the vertical frame members 1*a*, 1*b* adjacent to left and right each other, and a seal material 30 such as a packing band is mounted between the first large mounting recesses 18, 18 of the vertical frame members 1, 1 of the unit curtain walls Aa, Ab adjacent to top and bottom and left and right to connect a pair of vertical frame members 1*a*, 1*b* in a lateral direction.

In FIG. 3, a vertical batten 32 is mounted on the end wall 15*b* in the mounting piece 15 of each vertical frame member 1*a* or 1*b* by means of a screw 33 through a connecting member 31 formed of a heat insulating material, a panel 34 is held and mounted between an outer side wall 32*a* of the vertical batten 32 and the shorter side wall 12 of the vertical frame member 1*a*, the vertical batten 32 having the outer side wall 32*a* integrally formed with a bended wall 32*b* bended into a hook-shape to form a large recess 35, the bended wall 32*b* being formed with fourth and fifth small mounting recesses 36 and 37 opposed to the second and third small mounting recesses 19 and 20 of the mounting piece 15, a pair of connecting plates 38, 38 are fitted and mounted on the fourth and fifth small mounting recesses 36, 37 and the second and third small mounting recesses 19 and 20, a seal material 39 such as a packing band is fitted and mounted between the large recesses 35, 35 of the vertical battens 32, 32 opposed to each other, and a seal material 41 such as a packing band is fitted and mounted between the large recesses 17 and 17 of the vertical frame member 1 through a fitting 40.

Figure 4:
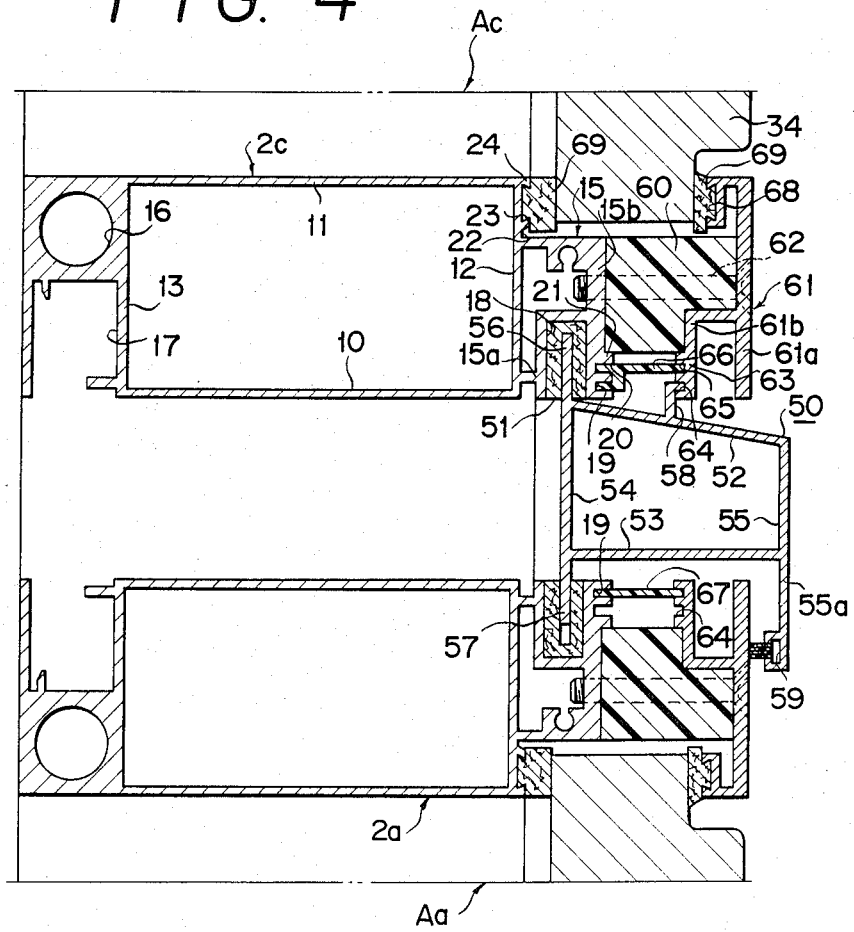

In case of using the section as the horizontal frame member, as shown in FIG. 4 the section is mounted so that the side wall 10 of the section is upwardly directed, the lower horizontal frame member 2*c* of the upper unit curtain wall unit Ac is mounted so that the longer side wall 10 is downwardly directed, and upper and lower ends of the connecting member 50 are fitted and mounted between the first large mounting recesses 18 and 18 opposed to each other through spacer members 51, 51.

That is, the connecting member 50 is provided with an upper wall 52, a lower wall 53, and inner and outer vertical walls 54, 55, the inner vertical wall 54 being continuously formed with a pair of upper and lower projections 56 and 57, the upper wall 52 being integrally formed with a hook 58, the outer vertical wall 55 being extended downwardly and formed at its end with a recess 59, the upper and lower projections 56, 57 being fitted and mounted on the first mounting recesses 18 and 18 through the spacer members 51, 51.

A horizontal batten 61 is mounted on the end wall 15*b* of the mounting piece 15 of each horizontal frame member by means of a screw 62 through a connecting member 60 formed of a heat insulating material in a manner similar to that as previously described, first and second small grooves 64 and 65 opposed to the second and third small mounting recesses 19 and 20 are formed in a bended piece 63 of the horizontal batten 61, an upper connecting plate 66 and a lower connecting plate 67 are fitted and mounted over the second and third small mounting recesses 19, 20 and the second small groove 65 and over the second mounting recess 19 and the first small groove 64, respectively, the hook 58 of the connecting member 50 being fitted and connected to the first small groove 64, and upper and lower end edges of the panel 34 are held and mounted through packing materials 69, 69 mounted between the pair of locking pieces 23 and 24 formed in the shorter side wall 12 of the horizontal frame member 2 and in a recess 68 of the horizontal batten 61.

Figure 5:
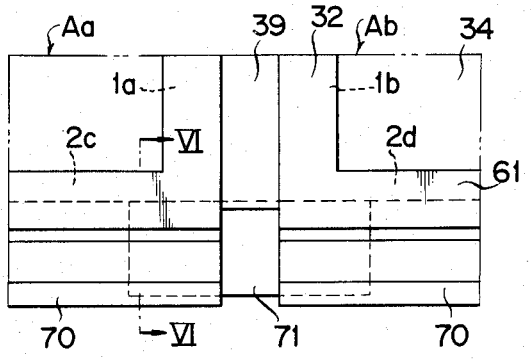
FIG. 5 is a detailed view of a V portion of FIG. 1.

FIG. 5 is a detailed view of a V portion of FIG. 1. Flashing plates 70 are respectively mounted on the lower horizontal members 2*c* and 2*d* (that is, lower frames) of the unit curtain wall units Aa, Ab adjacent to left and right at the lowermost position, and a back plate 71 is mounted over and between the flashing plates 70, 70 adjacent to each other.

Figure 6:
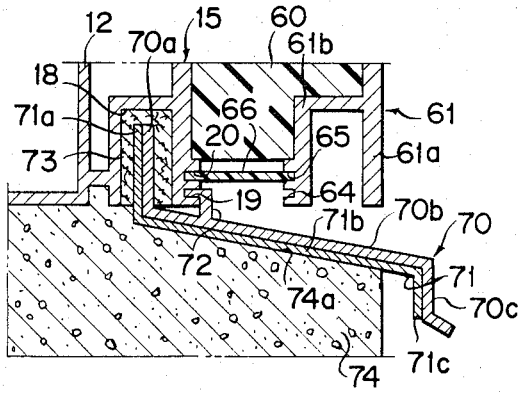
FIG. 6 is a sectional view taken on line VI—VI of FIG. 5.

In FIG. 6, the flashing plate 70 is provided with a mounting vertical piece 70*a*, an inclined piece 70*b* and a hanging piece 70*c*, the inclined piece 70*b* being integrally formed with a hook 72, the back plate 71 being provided with a mounting vertical piece 71*a*, an inclined piece 71*b* and a hanging piece 71*c*, each of the mounting vertical pieces 70*a* and 71*a* being fitted mounted within the first large mounting recess 18 through an elastic holding member 73, the inclined piece 71*b* of the back plate 71 coming into abutment with an inclined surface 74*a* of concrete 74 and an inclined piece 70*b* of the flashing plate 70 being placed in abutment therewith, the hook 72 being fitted and mounted on the second small mounting recess 19.

As described above, one and the same section can be utilized as the vertical frame member and horizontal frame member of the curtain wall unit, and the seal material such as a packing band, connecting member, connecting plate and flashing plates can be mounted.

Figure 7:
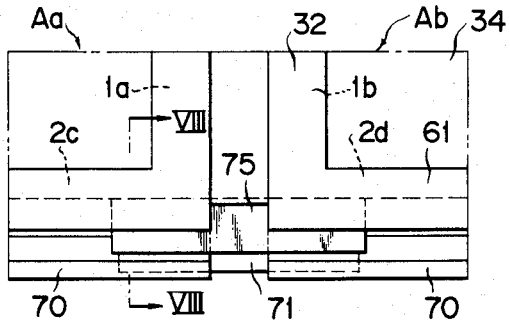
FIGS. 7 and 8 show another embodiments, FIG. 7 being a front view of a connecting portion between lower frames.
Figure 8:
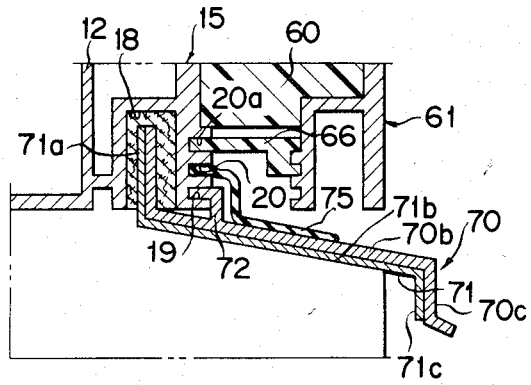

It should be noted that as shown in FIGS. 7 and 8, the mounting piece 15 can be formed with a third small mounting recess 20*a*, the connecting plate 66 can be mounted on the third small mounting recess 20*a*, and a flashing cover 75 formed of synthetic resin or the like can be fitted and mounted on the second small mounting recess 20.

While in the above-described embodiment, the section has been described as the vertical frame member and horizontal frame member for the curtain wall, it should be understood that it can be used as the vertical frame member and horizontal frame member for a window frame, a shoji screen frame (a paper sliding door) or the like.

What is claimed is:

1. A section for mounting a curtain wall on a wall of a building comprising:

a substantially rectangular hollow lengthy section body including as a frame thereof relatively shorter opposed side walls parallel to the building wall and relatively longer opposed side walls perpendicular to the building wall;

a mounting piece projecting from the one shorter side wall which faces the outside of the building;

at least one longitudinally continuous hollow portion formed at the other shorter side wall facing the inside of the building;

a pair of mounting recesses formed at and arranged in parallel to said shorter side walls, respectively, each opened toward a same one side perpendicular to each of said shorter side walls to be connected to another adjacent section body by a packing band used as a seal member of which one end is inserted into the recess; and a plurality of other mounting recesses formed at the outer side of said mounting piece, each opened toward the outside of the building.

2. A section as set forth in claim 1, characterized in that said mounting piece is integrally formed on the side of said shorter side wall facing the outside of the building.

3. A section as set forth in claim 1, characterized in that said pair of mounting recesses are relatively wide and deep, while said other mounting recesses are relatively narrow and shallow.

4. A section as set forth in claim 1, characterized in that said other mounting recesses are adjacent to each other.

* * * * *